US012084743B1

(12) United States Patent
Leibman et al.

(10) Patent No.: US 12,084,743 B1
(45) Date of Patent: Sep. 10, 2024

(54) METHOD EMBODIMENTS FOR EXTRACTING ELEMENTS FROM COAL COMBUSTION PRODUCTS

(71) Applicant: Triad National Security, LLC, Los Alamos, NM (US)

(72) Inventors: Christopher Leibman, Santa Fe, NM (US); Janelle Droessler, Los Alamos, NM (US); Iain May, Los Alamos, NM (US); Nicholas Hubley, Santa Fe, NM (US)

(73) Assignee: Triad National Security, LLC, Los Alamos, NM (US)

( * ) Notice: Subject to any disclaimer, the term of this patent is extended or adjusted under 35 U.S.C. 154(b) by 650 days.

(21) Appl. No.: 17/201,729

(22) Filed: Mar. 15, 2021

Related U.S. Application Data

(60) Provisional application No. 62/989,497, filed on Mar. 13, 2020.

(51) Int. Cl.

| | |
|---|---|
| ***C22B 3/14*** | (2006.01) |
| ***C22B 3/20*** | (2006.01) |
| ***C22B 59/00*** | (2006.01) |
| ***C22B 60/02*** | (2006.01) |

(52) U.S. Cl.
CPC ..... *C22B 3/14* (2013.01); *C22B 3/20* (2013.01); *C22B 59/00* (2013.01); *C22B 60/0252* (2013.01); *C22B 60/0291* (2013.01); *C22B 60/0295* (2013.01)

(58) Field of Classification Search
None
See application file for complete search history.

(56) References Cited

FOREIGN PATENT DOCUMENTS

WO WO-01/16386 A1 * 3/2001 ..... C22B 7/04
WO WO-2008130737 A1 * 10/2008 ..... G01N 21/643

OTHER PUBLICATIONS

Krishna, M. V., et al. Development of a simple and robust microwave-assisted decomposition method for the determination of rare earth elements in coal fly ash by ICP-OES. Anal. Methods, 2017, 9, 2031. (Year: 2017).*

Balarama Krishna et al., "An integrated approach based on oxidative pyrolysis and microwave-assisted digestion for the multi-elemental analysis of coal samples by ICP-based techniques," *Fuel*, 158, Jun. 18, 2015, 770-778.

Balarama Krishna et al., Development of a simple and robust microwave-assisted decomposition method for the determination of rare earth elements in coal fly ash by ICP-OES, *Anal. Methods*, Feb. 28, 2017, 9, 2031.

Hower et al., "Ponded and Landfilled Fly Ash as a Source of Rare Earth Elements from a Kentucky Power Plant," *Coal Combustion and Gasification Products*, 9, Jan. 1, 2017.

(Continued)

*Primary Examiner* — Anthony J Zimmer
*Assistant Examiner* — Zachary John Baum
(74) *Attorney, Agent, or Firm* — Klarquist Sparkman, LLP

(57) ABSTRACT

Disclosed herein are embodiments of methods for isolating rare earth elements (REEs) and radioisotopes from coal combustion products, such as fly ash. In particular embodiments, lanthanides, Al, Sc, Y, or compounds comprising lanthanides, AI, Sc, Y, or any combination thereof; or actinides can be isolated using the methods disclosed herein.

17 Claims, 8 Drawing Sheets

(56) References Cited

OTHER PUBLICATIONS

Husakova et al., "Simultaneous Determination of 11 Elements in Fly Ash by Inductively Coupled Plasma Orthogonal Acceleration Time-of-Flight Mass Spectrometry After Closed- Vessel Microwave-Assisted Extraction with Ammonium Fluoride[1]," *Journal of Analytical Chemistry*, Jul. 4, 2018, vol. 73, No. 7, pp. 650-660.
O'Hara et al., "Decomposition of diverse solid inorganic matrices with molten ammonium bifluoride salt for constituent elemental analysis," *Chemical Geology*, 466, Jun. 20, 2017, 341-351.
Zhang et al., "Recent advances in sample preparation methods for elemental and isotopic analysis of geological samples," *Spectrochimica Acta Part B*, 160, Aug. 29, 2019.

* cited by examiner

METHOD EMBODIMENTS FOR EXTRACTING ELEMENTS FROM COAL COMBUSTION PRODUCTS

CROSS REFERENCE TO RELATED APPLICATION

This application claims the benefit of the earlier filing date of U.S. Provisional Patent Application No. 62/989,497, filed on Mar. 13, 2020, the entirety of which is incorporated herein by reference in its entirety.

ACKNOWLEDGMENT OF GOVERNMENT SUPPORT

This invention was made with government support under Contract No. 89233218CNA000001 awarded by the U.S. Department of Energy/National Nuclear Security Administration. The government has certain rights in the invention.

FIELD

Disclosed herein are embodiments of methods for isolating elements and/or compounds, such as rare earth elements (REEs) and actinides, from coal combustion products, such as fly ash.

BACKGROUND

Current extraction methods for separating and isolating rare earth elements (REE) from sources, such as coal fly ash, typically employ extraction methods, such as high temperature alkali roasting or sulfuric, nitric, or hydrochloric acid leaching to release the REE. However, such methods are inefficient, expensive, generate undesirable waste products, and exhibit low selectivity for REEs; thus, industrial-scale application of such methods is not viable. There exists a need in the art for more efficient methods for isolating elements and/or compounds from coal combustion sources/products to provide methods that can be performed safely and efficiently on industrial scale.

SUMMARY

Disclosed herein are embodiments of a method, comprising contacting a coal combustion product comprising (i) at least one target element or a compound thereof and (ii) an aluminosilicate or silicate with ammonium bifluoride and at least one aqueous solution to solubilize the at least one target element or the compound thereof; provided that the method does not comprise exposing the coal combustion product, the ammonium bifluoride, or the at least one aqueous solution to microwaves or sonication.

In some embodiments, the method comprises contacting fly ash with ammonium bifluoride to extract an REE, an actinide, a transition metal, a main-group element present in the fly ash, or to extract a compound comprising an REE, an actinide, a transition metal, or a main-group element present in the fly ash, wherein the fly ash is contacted with the ammonium bifluoride at ambient temperature.

In some embodiments, the coal combustion product sample comprises aluminosilicate and at least one target element or compound, and the at least one target element or compound is solubilized during the method. In particular embodiments, the method can be used to isolate target elements, such as lanthanides, Al, Sc, Y, or actinides and/or compounds comprising the same.

In some embodiments, the coal combustion product can first be contacted with ABF and water to extract or isolate an actinide, such as U. The coal combustion product can then be contacted with ABF and an aqueous solution comprising an acid to extract a different element, such as a lanthanide, Al, Sc, Y, or a combination thereof. In such embodiments, after the at least one target element is solubilized, the method can further comprise recovering, concentrating, or separating the at least one target element, such as using ion exchange or solvent extraction, such as where the at least one target element is a lanthanide, Al, Sc, or Y (or a compound comprising a lanthanide, Al, Sc, Y, or any combination thereof).

The foregoing and other objects and features of the present disclosure will become more apparent from the following detailed description, which proceeds with reference to the accompanying figures.

DETAILED DESCRIPTION

Overview of Terms

Figure 1:
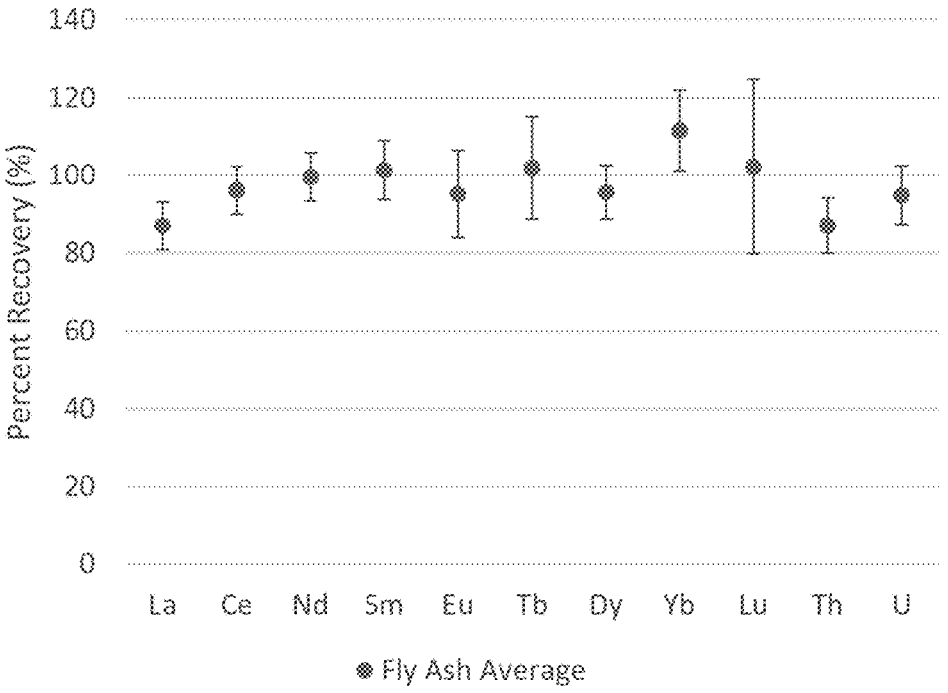
FIG. 1 shows lanthanide and actinide percent recovery from NIST 1633c using ABF fusion (n=3).

The following explanations of terms are provided to better describe the present disclosure and to guide those of ordinary skill in the art in the practice of the present disclosure. As used herein, "comprising" means "including" and the singular forms "a" or "an" or "the" include plural references unless the context clearly dictates otherwise. The term "or"

refers to a single element of stated alternative elements or a combination of two or more elements, unless the context clearly indicates otherwise.

Although the steps of some of the disclosed methods are described in a particular, sequential order for convenient presentation, it should be understood that this manner of description encompasses rearrangement, unless a particular ordering is required by specific language set forth below. For example, steps described sequentially may in some cases be rearranged or performed concurrently. Additionally, the description sometimes uses terms like "produce" and "provide" to describe the disclosed methods. These terms are high-level abstractions of the actual steps that are performed. The actual steps that correspond to these terms will vary depending on the particular implementation and are readily discernible by one of ordinary skill in the art.

Unless explained otherwise, all technical and scientific terms used herein have the same meaning as commonly understood to one of ordinary skill in the art to which this disclosure belongs. Although methods and compounds similar or equivalent to those described herein can be used in the practice or testing of the present disclosure, suitable methods and compounds are described below. The compounds, methods, and examples are illustrative only and not intended to be limiting, unless otherwise indicated. Other features of the disclosure are apparent from the following detailed description and the claims.

Unless otherwise indicated, all numbers expressing quantities of components, molecular weights, percentages, temperatures, times, and so forth, as used in the specification or claims are to be understood as being modified by the term "about." Accordingly, unless otherwise indicated, implicitly or explicitly, the numerical parameters set forth are approximations that can depend on the desired properties sought and/or limits of detection under standard test conditions/methods. When directly and explicitly distinguishing embodiments from discussed prior art, the embodiment numbers are not approximates unless the word "about" is recited. Furthermore, not all alternatives recited herein are equivalents.

To facilitate review of the various embodiments of the disclosure, the following explanations of specific terms and abbreviations are provided:

- Acid: A molecule or ion capable of donating a proton (e.g., a hydrogen ion H+), such as inorganic acids (e.g., nitric acid or sulfuric acid) or organic acids (e.g., oxalic acid, acetic acid, or citric acid).
- Actinide: A chemical element of the periodic table, typically a metal, that can be naturally occurring or not naturally occurring. Naturally occurring actinides can include actinium (Ac), thorium (Th), uranium (U), and protactinium (Pa). Such actinides may be found in coal combustion products, such as fly ash. Non-naturally occurring actinides can include berkelium (Bk), californium (Cf), einsteinium (Es), fermium (Fm), mendelevium (Md), nobelium (No), plutonium (Pu), neptunium (Np), americium (Am), curium (Cm), and lawrencium (Lr).
- Aluminosilicate: A silicate in which aluminum replaces some of the silicon in the matrix. In some embodiments, the aluminosilicate may have a formula $Al_xSi_yO_z$, where x, y, and z are integers and wherein the relative ratios of x, y, and z may vary.
- Compound: A combination of metals or metals combined with one or more other elements. In particular examples, lanthanide, Al, Sc, or Y are combined with another element (such as another lanthanide, Al, Sc, or Y) to form a compound. In particular examples, the compound is an alloy.
- Ammonium Bifluoride (ABF): An inorganic compound with the formula $NH_4HF_2$ or $NH_4F{\cdot}HF$.
- Coal Combustion Product (CCP): Also known as coal combustion wastes (CCWs) or coal combustion residuals (CCRs), CCPs can be categorized based on physical and chemical forms derived from coal combustion methods and emission controls. For example, CCPs can include fly ash (a coal combustion product that is driven upward after combustion); flue-gas desulfurization (FGD) materials (such as those produced by chemical "scrubber" emission control systems that remove sulfur and oxides from power plant flue gas streams); bottom ash (a coal combustion product that is driven downward after combustion); boiler slag (molten bottom ash); or combinations thereof. In independent embodiments, a CCP does not include coal itself.
- Contacting: Placing in direct physical association; includes both in solid and liquid form. For example, contacting can occur by exposing a coal combustion product (CCP) to ammonium bifluoride (ABF), water, and/or an aqueous acid.
- Fly Ash: A coal combustion product comprising particulates produced by coal-fired boilers together with flue gases and that are driven upward after combustion. Fly ash can comprise substantial amounts of silicon dioxide ($SiO_2$), aluminum oxide ($Al_2O_3$), calcium oxide (CaO), mixtures thereof, and trace elements (such as lanthanides, Al, Sc, Y, or actinides). For example, in particular embodiments, fly ash comprises silicate (for example, aluminosilicate), such as a matrix formed by aluminosilicate, for example, an aluminosilicate matrix comprising lanthanides, Al, Sc, Y, or actinides.
- Lanthanide: A chemical element, typically a metal and selected from lanthanum (La), cerium (Ce), praseodymium (Pr), neodymium (Nd), promethium (Pm), samarium (Sm), europium (Eu), gadolinium (Gd), terbium (Tb), dysprosium (Dy), holmium (Ho), erbium (Er), thulium (Tm), ytterbium (Yb), and lutetium (Lu). Rare earth elements are included.
- Nitric Acid: $HNO_3$.
- Radioisotope: An atom that has more nuclear energy than its parent atom. Radioisotopes can be naturally occurring (such as uranium), produced as a result of nuclear fission, and/or synthetic. In particular examples, the radioisotope is an actinide.
- Rare Earth Element: A metal that also can be a lanthanide and further including scandium and yttrium. In some embodiments, a complex comprising a rare earth metal can comprise the rare earth metal in any possible oxidation state and such possible oxidation states are recognizable by those of ordinary skill in the art with the benefit of the present disclosure.
- Silicate: A member of a family of anions that include silicon and oxygen. Silicates can have a formula as illustrated below, where $0 \leq x < 2$ and n is an integer, such as 1, 2, or the like.

$$[Sio_{4-x}^{(4-2x)-}]_n$$

In some embodiments, a silicate forms a matrix with other elements, such as rare earth elements (REEs) and radioisotopes (such as uranium) in coal combustion products. In particular embodiments, the silicate is aluminosilicate.

Sulfuric Acid: Also known as vitriol or sulphuric acid, and having a formula $H_2SO_4$.

INTRODUCTION

Rare earth elements (REEs) are useful for applications such as electronics, automotives, and energy. These elements include lanthanides, as well as scandium and yttrium. Despite the name, REEs are relatively abundant with the total average content in the earth's crust being 160 to 205 mg/kg. Commercially, these elements have been obtained from minerals of bastnaesite, monazite, xenotime, and ion-absorbed clays with limited processing capabilities.

Sources of REEs include coal fly ash, a waste product from the combustion of coal, such as in power generation. Coal fly ash is an exemplary coal combustion product (also referred to herein as a CCP). Approximately 45 million metric tons of coal fly ash is produced annually in addition to other CCPs. Some CCPs are used in concrete and other construction materials, but the rest is disposed in landfills or stored in wet impoundments where contamination of the environment is a concern. REEs are enriched in fly ashes, in part due to enrichment in coal source materials. Extraction of REEs from coal fly ash is desirable as there are large quantities of fly ash readily available, which is in a state that is easy to process. There also are environmental incentives to remove hazardous materials from fly ash. The amount of REEs in fly ash depends on the source of coal, as some coals are richer in REEs than others. Typically, REEs reside in glassy aluminosilicate phases within the fly ash. As such, previous methods to extract REEs utilize harsh conditions, such as $HF/HNO_3$ and alkali fusions, or other chemicals (e.g., HCl and NaOH) that are difficult to employ on an industrial scale due to corrosion or increased metal loading. Further, such methods typically rely on high temperature treatments and/or microwave or sonication treatments to promote extraction. Such conditions typically are only performed on an analytical scale, such as in a laboratory. Such conditions and reagents, however, are not suitable for industrial scale extractions and do not provide a viable or economical approach to extracting elements or compounds of interest from CCPs.

Herein, method embodiments of extracting various elements and/or compounds from CCPs, such as fly ash, are disclosed. Elements and/or compounds that can be obtained from the CCPs can include, but are not limited to, REEs, actinides, transition metals, main-group elements, and/or compounds comprising the same. In some embodiments, the method comprises high temperature fusion with $NH_4HF_2$ and nitric acid ($HNO_3$). In other embodiments, the method comprises leaching with ABF and $HNO_3$ or sulfuric acid ($H_2SO_4$) to extract the elements and/or compounds from fly ash. A challenge for using coal fly ash as a source of rare earth elements is the large cost of dissolution; thus, the methods of using ABF disclosed herein provide a less expensive alternative for extracting elements and/or compounds from such CCPs, particularly when compared with methods that rely on concentrated mineral acids.

Method Embodiments

Disclosed herein are embodiments of a method for obtaining elements and/or compounds from CCPs. In some embodiments, elements and/or compounds that are present in fly ash can be obtained, including, but not limited to, REEs (e.g., a lanthanide, scandium, or yttrium), actinides (e.g., actinium, thorium, uranium, or protactinium), transition metals (e.g., nickel, tungsten, or other transition metals found in fly ash), main-group elements (e.g., aluminum, lithium, beryllium, astatine, rubidium, antimony, cesium, or other main-group elements found in fly ash), any combinations thereof, and/or compounds comprising the same. In particular embodiments, the method can be used to isolate REEs, actinides, transition metals, main-group elements, and/or compounds comprising the same from coal ash. In particular embodiments, the method can be used to isolate lanthanides, Al, Sc, Y, actinides (or a compound comprising any such elements) from coal ash. In particular embodiments, the compounds can be an alloy comprising an REE, an actinide, a transition metal, or a main-group element.

In particular embodiments, the disclosed method embodiments provide high yields of rare earth elements (REEs) or actinides (such as radioisotopes) from CCPs, for example, without requiring full dissolution of the CCP in its entirety. In particular embodiments, the method can be used to recover at least 20% to 100% of the element and/or compound of interest that is present in a CCP. In particular embodiments, the method can be used to recover at least 20% to 100% of a total amount of a single element and/or compound of interest present in a CCP, or at least 20% to 100% of any element and/or compound of interest present in a sample, or at least 20% to 100% of any compounds comprising an element and/or compound of interest. In some embodiments, the yield of any such elements and/or compounds can range from at least 20% to 100%, such as 30% to 100%, or 40% to 100%, or 50% to 100%, or 60% to 100%, or 70% to 100%, or 75% to 100%, or 80% to 100%, or 85% to 100%, or 90% to 100%, or 95% to 100% of the element and/or compound (or multiple elements and/or compounds) present in the CCP. In some embodiments, the yield can be 70%, 75%, 80%, 85%, 90%, 95%, or 100%. The percentages listed herein for recovery percentages can be weight percent values.

The methods disclosed herein can be used to dissolve a silicate-containing matrix of CCPs, allowing release of elements contained therein (for example, $SiO_2$+4 $[NH_4][HF_2] \rightarrow SiF_4$+4 $NH_4F$+2 $H_2O$). In some embodiments, the silicate-containing matrix can be an aluminosilicate-containing matrix. In particular disclosed embodiments, the method can comprise contacting a CCP with ABF and at least one aqueous solution. In an independent embodiment, ammonium fluoride (AF) is used. The method is compatible with a variety of CCPs, including, for example, solid CCPs. In some embodiments, CCPs with at least one target element (or target compound) and silicate can be used. In some embodiments, the CCP is one or more of fly ash, bottom ash, or boiler slag. In particular embodiments, fly ash is used as the CCP. Any variety of fly ash can be used. For example, in some embodiments, class C or class F fly ash can be used. Further, various amounts of CCP and ABF can be used in the method. For example, different ratios of ABF:CCP can be used, such as 0.5:1 to 10:1 (ABF:CCP), or 0.75:1 to 10:1 (ABF:CCP), or 1:1 to 10:1 (ABF:CCP), or 2:1 to 10:1 (ABF:CCP), or 10:1 to 100:1 (ABF:CCP), or at least 0.5:1 (ABF:CCP), 1:1 (ABF:CCP), 2:1 (ABF:CCP), 3:1 (ABF:CCP), 4:1 (ABF:CCP), 5:1 (ABF:CCP), 8:1 (ABF:CCP), 10:1 (ABF:CCP), 12 (ABF:CCP), 15:1 (ABF:CCP), 20:1 (ABF:CCP), 25:1 (ABF:CCP), 50:1 (ABF:CCP), or 100:1 (ABF:CCP). In particular embodiments, a ratio of 2:1 or 10:1 (ABF:CCP) is used. In particular disclosed embodiments, a ratio of 2:1 or 10:1 ABF:fly ash can be used.

Through dissolving the silicate-containing matrix of CCPs using the ABF, a solvent solution can be applied to dissolve one or more target elements. Thus, in some embodiments, the ABF and CCP combination is contacted with an aqueous solution. The ABF and CCP combination can be contacted with the aqueous solution in a variety of configurations. For example, both or one of the ABF and CCP can be dissolved in an aqueous solution (e.g., a liquid form of ABF can be used) and then mixed, or both or one of the ABF and CCP can be combined together as solids and then contacted with the aqueous solution. A variety of aqueous solutions can be used. For example, water, an acid, or a combination thereof can be used. In particular embodiments, water is used, such as where the target element is an actinide, such as U.

In particular embodiments, an acid is used, such as where the target element is a lanthanide, Al, Sc, Y (or a compound comprising any combination of a lanthanide, Al, Sc, or Y). In embodiments where an acid is used, a variety of acids and acid concentrations can be used. For example, in some embodiments, inorganic acids can be used, such as nitric acid, sulfuric acid, hydrochloric acid, or combinations thereof. In yet other embodiments, organic acids can be used, such as oxalic acid, acetic acid, citric acid, or combinations thereof. In some embodiments, the concentration of the acid is 8 M or less, such as greater than 0 M to 8 M, or 0.5 M to 8 M, or 1 M to 8 M. In particular embodiments, acids with a concentration of 0.5 M, 1 M, 2 M, 4 M, or 8 M can be used. In particular embodiments, the concentration of the acid is 1 M or 2 M. In particular embodiments, the concentration of the acid is less than or equal to 2 M, such as where the acid is nitric acid or sulfuric acid. In particular embodiments, 2 M nitric acid or 2 M sulfuric acid is used. In particular embodiments, the concentration of the acid is less than or equal to 1 M, such as where the acid is sulfuric acid. In particular embodiments, 1 M sulfuric acid is used. In particular embodiments, 0.5 M nitric acid or 0.5 M sulfuric acid is used. In particular embodiments, the concentration of the acid is less than or equal to 0.5 M.

A variety of temperatures can also be used in the contacting step. In some embodiments, the ABF and the CCP (individually or in combination) are contacted with an aqueous solution at a temperature ranging from ambient temperature to 300° C., such as 18° C. to 37° ° C., or 18° C. to 28° C., or 20° C. to 28° C., or 18° C. to 50° C., or 18° C. to 100° C., or 20° C. to 100° C., 20° C. to 200° C., or 20° C. to 300° C., or 20° C. to 150° C., or 100° C. to 250° C., or 200° C. to 300° C. In some embodiments, a temperature of 18° C., 20° C., 22° C., 25° C., 28° C., 32° C., 37° C., 40° C., 42° C., 50° C., 100° C., 200° C., or 230° C. is used. In particular embodiments, the temperature is lower than 230° C., such as lower than 150° C., or lower than 100° C., or lower than 80° C. In some such embodiments, particularly in embodiments conducted at temperatures below 100° C., the method does not include using microwaves or sonication to facilitate extraction.

The ABF and CCP (individually or in combination) can be contacted with an aqueous solution for a time period sufficient to facilitate extraction of the desired element and/or compound (or combination thereof). In some embodiments, the time period ranges from 1 hour to 24 hours, or 2 hours to 24 hours, or 1 hour to 3 hours, or 18 hours to 24 hours. In some embodiments, the time period is at least 30 minutes, or 1 hour, or 1.5 hours, or 2 hours, or 3 hours, or 4 hours, or 8 hours, or 12 hours, or 24 hours. In particular embodiments, the time period is 2 hours or 24 hours. In yet other embodiments, longer time periods can be used, such as one day to a period of months (e.g., 1, 2, 3, 4, 5, or 6 months). In some embodiments, the contacting occurs for 24 hours at ambient temperature, such as at a temperature ranging from 20° C. to 28° C. (e.g., 25° C.). In some embodiments, the contacting occurs for 1 hour at ambient temperature, such as at a temperature ranging from 20° C. to 28° C. (e.g., 25° C.). In particular embodiments, the amount of time for which the contacting occurs is related to the temperature. For example, in some embodiments, higher temperatures can be used for lower periods of time. In some other embodiments, lower temperatures can be used for higher periods of time. Table 1 provides particular embodiments of types and concentrations of acids in some embodiments of the aqueous solution as well as embodiments of temperature ranges that are also disclosed herein.

TABLE 1

| Acid | Concentration Range (M) | Temperature (° C.) |
|---|---|---|
| $HNO_3$ | 0-8 | Ambient temperature (e.g., 20° C.) – 100° C. |
| $H_2SO_4$ | 0-9 | Ambient temperature (e.g., 20° C.) – 100° C. |
| HCl | 0-8 | Ambient temperature (e.g., 20° C.) – 100° C. |

In some embodiments, varying conditions for the contacting step of the disclosed method, such as the temperature, concentration (such as concentration of an acid in the aqueous solution), or the time period, can be used to alter the amount of yield for a target element or to select a target element. For example, in particular embodiments, the method can be used to remove a target element from a CCP, such as an actinide (for example, U) or toxic element, for example, Cr, Co, Pb, Ba, or Fe. Thus, the CCP without the actinide (for example, U) or toxic element, for example, Cr, Co, Pb, Ba, or Fe can then be safely used in further applications (such as asphaltic concrete pavement, soil stabilization, road base, structural fill, embankments, mine reclamation, filler in wood and plastic products, and paints and metal castings) or disposed of as non-toxic waste. In some embodiments, the conditions of the method disclosed herein can be varied to target an additional element or elements of interest. In some embodiments, the method can be used to extract a target element and/or compound from a CCP, such as an REE (e.g., a lanthanide, scandium, or yttrium), an actinide (e.g., actinium, thorium, uranium, or protactinium), a transition metal (e.g., nickel, tungsten, or other transition metals found in fly ash), a main-group element (e.g., aluminum, lithium, beryllium, astatine, rubidium, antimony, cesium, or other main-group elements found in fly ash), and/or compounds comprising the same. Such extracted target elements and/or compounds can then be used in further applications.

After solubilization, the method can further comprise recovering, concentrating, and/or separating the solubilized target element and/or compound. A variety of techniques can be used for recovering, concentrating, or separating. In particular embodiments, more than one target element is isolated. In some embodiments, the method includes separating at least two target elements or types of target elements. For example, at least one actinide can be separated from at least one lanthanide, Al, Sc, Y, or a compound thereof, such as using a first contacting step and a second contacting step. In some embodiments, a first contacting step can comprise contacting the CCP particulate sample with ABF and a first aqueous solution as described herein, wherein the first aqueous solution is water. In particular embodiments, the water and ABF solubilize target elements (e.g., actinides) in the CCP, which can then be recovered, concentrated, or separated as described herein. In a particular embodiment, the remaining solid or particulate CCP can be separated from the target actinide elements (such as by filtering or sedimentation), and then a second target element can be solubilized. In some embodiments, the solid or particulate CCP can then be contacted with ABF and a second aqueous solution as described herein. In particular embodiments, the second aqueous solution comprises an acid (such as nitric acid, sulfuric acid, oxalic acid, acetic acid, or citric acid). In particular embodiments, the acid and ABF solubilize target elements selected from REEs (e.g., a lanthanide, scandium, or yttrium), actinides (e.g., actinium, thorium, uranium, or protactinium), transition metals (e.g., nickel, tungsten, or other transition metals found in fly ash), main-group elements (e.g., aluminum, lithium, beryllium, astatine, rubidium, antimony, cesium, or other main-group elements found in fly ash), and/or compounds comprising the same, which can then be recovered, concentrated, or separated as described herein.

In an independent embodiment, the method does not comprise using microwave-assisted digestion/decomposition and does not include any steps whereby microwaves are used to facilitate element extraction.

Overview of Several Embodiments

Disclosed herein are embodiments of a method comprising contacting a coal combustion product comprising (i) at least one target element or a compound thereof and (ii) an aluminosilicate or silicate with ammonium bifluoride and at least one aqueous solution to solubilize the at least one target element or the compound thereof; provided that the method does not comprise exposing the coal combustion product, the ammonium bifluoride, or the at least one aqueous solution to microwaves or sonication.

In some embodiments, the aqueous solution is water, acid, or a combination thereof.

In any or all of the above embodiments, the at least one target element is an REE selected from a lanthanide, scandium, yttrium, or a combination thereof; an actinide selected from actinium, thorium, uranium, protactinium, or a combination thereof; a transition metal selected from nickel, tungsten, or a combination thereof; a main-group elements selected from aluminum, lithium, beryllium, astatine, rubidium, antimony, cesium, or a combination thereof; or a combination of an REE, an actinide, a transition metal, or a main-group element.

In any or all of the above embodiments, the at least one target element is a lanthanide, Al, Sc, Y, U, or a combination thereof.

In any or all of the above embodiments, the at least one target element is an actinide, and the aqueous solution is water; or the at least one target element is a lanthanide, Al, Sc, Y, or a combination thereof and the aqueous solution comprises an acid.

In any or all of the above embodiments, the coal combustion product is first contacted with ammonium bifluoride and water to extract an actinide; and the coal combustion product is then contacted with ammonium bifluoride and an aqueous solution comprising an acid to extract a lanthanide, Al, Sc, Y, or a combination thereof.

In any or all of the above embodiments, the method further comprises recovering, concentrating, and/or separating the at least one target element using ion exchange and/or solvent extraction.

In any or all of the above embodiments, the aqueous solution comprises an acid selected from an inorganic acid or an organic acid.

In any or all of the above embodiments, the inorganic acid is selected from sulfuric acid, hydrochloric acid, nitric acid, or a combination thereof; and wherein the organic acid is selected from oxalic acid, acetic acid, or citric acid.

In any or all of the above embodiments, the concentration of the acid ranges from 0.5 M to 2 M.

In any or all of the above embodiments, the acid concentration is 1 M or 2 M.

In any or all of the above embodiments, contacting occurs at a temperature ranging from 18° C. to 100° C.

In any or all of the above embodiments, contacting occurs at a temperature below 80 °C.

In any or all of the above embodiments, the coal combustion product sample is contacted with the ABF and the at least one aqueous solution for a time period of 30 minutes to 24 hours.

In any or all of the above embodiments, the coal combustion product comprises fly ash, bottom ash, or boiler slag.

In any or all of the above embodiments, the coal combustion product comprises fly ash.

In any or all of the above embodiments, the method comprises contacting fly ash with ammonium bifluoride to extract an REE, an actinide, a transition metal, a main-group element present in the fly ash, or to extract a compound comprising an REE, an actinide, a transition metal, or a main-group element present in the fly ash, wherein the fly ash is contacted with the ammonium bifluoride at ambient temperature.

In any or all of the above embodiments, the REE is selected from a lanthanide, scandium, yttrium, or a combination thereof; the actinide is selected from actinium, thorium, uranium, protactinium, or a combination thereof; the a transition metal is selected from nickel, tungsten, or a combination thereof; and the main-group element is selected from aluminum, lithium, beryllium, astatine, rubidium, antimony, cesium, or a combination thereof.

In any or all of the above embodiments, the method further comprises contacting the fly ash with an aqueous solution comprising an acid selected from sulfuric acid, hydrochloric acid, nitric acid, oxalic acid, acetic acid, or citric acid.

EXAMPLES

Example 1—Methods

ABF Fusion of NIST Reference Fly Ash: In this example, approximately 20 mg of NIST 1633c fly ash reference material were weighed into a screw-top conical 15 mL Savillex PFA tube. ABF was then added so that a 10:1 ABF to sample ratio was obtained. The cap was loosely closed, so that if gases were formed, they could escape, and the sample was placed into an aluminum hot block at 230° C. and heated for two hours. The sample was cooled, and 2 mL of 16 M $HNO_3$ was added to the tube. The solution was heated at 160° C. in the hot block for 1 hour. The solution was transferred to a PTFE beaker using 18.3 MΩ $H_2O$ and heated to a small liquid bead. Two milliliters of 16 M $HNO_3$ was added to the beaker while washing down the sides of the beaker. The solution was then evaporated a second time to near-dryness. When the sample was sufficiently cool, 2 mL of 8 M $HNO_3$ was added, and the residue was broken up. The solution was then transferred to a 50 mL Falcon tube and diluted to approximately 20 mL with 18.3 MΩ $H_2O$. Dilution for ICP-MS analysis was accomplished by taking a 1 mL aliquot of the 20 mL solution and diluting to 10 mL with 18.3 MΩ $H_2O$. This procedure was performed on three samples of the fly ash.

Leaching of NIST 1633c Fly Ash with ABF/$HNO_3$ Solution: In this example, four samples of approximately 20 mg of NIST 1633c fly ash were weighed into four 60 mL screw-top PFA jars from Savillex. ABF was added to three jars so that approximately 10:1 ABF to sample ratios by mass were produced. The samples with ABF contained 8 mL of 8 M, 4 M, or 2 M $HNO_3$. The fourth sample contained only 8 M $HNO_3$ for comparison. Stir bars were added to each jar, which were then loosely closed with their caps. The samples were stirred at a moderate rate at ambient temperature. Further, 0.04 mL aliquots were taken daily over two weeks to test the time-dependence of the leach. The aliquots were diluted to 10 mL in 15 mL polypropylene tubes with 18.3 MΩ $H_2O$ for analysis by ICP-MS.

In this example, the nitric acid concentration was further lowered. Twenty milligrams of NIST 1633c fly ash was combined with 200 mg of ABF in four PFA jars. Eight milliliters of $HNO_3$ was added to three jars with acid concentrations of 2 M, 1 M, and 0.5 M $HNO_3$. Further, 18.3 MΩ $H_2O$ was used for the fourth sample. The samples were stirred for 24 hours at ambient temperature with a moderate stir rate. The solutions were transferred to 50 ml polypropylene tubes and diluted to 30 mL with 18.3 MΩ $H_2O$. For ICP-MS analysis, 1 mL aliquots were taken and diluted to 10 mL with 18.3 MΩ $H_2O$.

All fusion and leach fly ash samples were measured on a THERMO SCIENTIFIC® X Series II ICP-MS with a Peltier cooled cyclonic concentric spray chamber and Elemental Scientific Instrument micro-FAST sample introduction system. Multi-element standards from INORGANIC VENTURES™ were used for calibration and verification as well as a rhodium internal standard.

Optimization of Leaching of NIST 1633c Fly Ash with ABF: In this example, 20 mg of NIST 1633c fly ash was weighed into 60 mL PFA jars and combined with 200 mg of ABF and varying sulfuric acid concentrations, ranging from 1 M, 2 M, 4 M, and 6 M. The solutions were mixed at 600 rpm for 24 hours at ambient temperature before an aliquot was taken and further diluted for analysis by ICP-MS.

Further, 20 mg of NIST 1633c fly ash was weighted into 60 mL PFA jars and combined with 40 mg of $NH_4HF_2$ and varying concentrations of nitric acid (2 M, 4 M, and 6 M) and sulfuric acid (1 M, 2 M, 4 M, and 6 M). The solutions were stirred at ambient temperature for 24 hours at 600 rpm. Aliquots of the sample solution were taken for further dilution before analysis by ICP-MS.

Scale-up of ABF/$H_2SO_4$ L each: In this example, two samples of 100 mg of NIST 1633c fly ash were weighed into 60 mL PFA jars. Further, 200 mg of ABF was also weighed into each jar. Two molar $H_2SO_4$ was added, and the samples were stirred at 600 rpm for 24 hours. Another sample was prepared in the same way and stirred for 6 hours at 600 rpm. Leaches were performed at ambient temperature. At the conclusion of the reaction time, aliquots of the sample were taken and diluted for ICP-MS analysis for elemental concentration.

Micro-Raman and SEM/EDS Analysis of Fly Ash Residue: In this example, NIST 1633c fly ash reference material was processed by nitric acid boil and ABF fusion. The residues were compared to undigested material to verify that the release of the REEs were from the removal of the aluminum/silicate matrices. The nitric acid and ABF procedures are as follows.

Nitric Acid Boil: In this example, approximately 21 mg of NIST 1633c fly ash was weighed into a conical 15 mL Savillex tube along with 2 mL of concentrated $HNO_3$. The tube was tightly closed, and the acid was rolled around the tube to capture all particles that may have clung to the sides of the tube. The lid was loosened, and the solution was boiled for 2 hours at 160° C. in an aluminum hot block. The solution was quantitatively transferred to a PTFE beaker with 18 MΩ $H_2O$. The solution was evaporated on a hot plate to a small liquid bead, transferred to a 15 mL Falcon tube, and diluted to 10 mL with 18 MΩ $H_2O$. The sample was filtered to isolate the solid, rinsed with 18 MΩ $H_2O$, and dried over a weekend. Some of the solids were transferred to a glass scintillation vial to be analyzed by Raman spectroscopy and SEM/EDS. ABF Fusion: In this example, approximately 21 mg of NIST 1633c fly ash was weighed into a conical 15 mL Savillex tube with about 210 mg of ABF. The tube was loosely closed and heated in an aluminum hot block for 2 hours at 230° C. Afterwards, 2 mL of concentrated $HNO_3$ was added to the tube, and the sample was heated at 160° C. for 1 hour in the aluminum hot block. The sample was then transferred to a PTFE beaker with 18 MΩ $H_2O$ and evaporated on a hot plate to a small bead. The sample was diluted to 10 mL with 18 MΩ $H_2O$ and filtered to isolate the solid material. The solid was washed with 18 MΩ $H_2O$ and dried over a weekend. Some of the solid was transferred to a glass scintillation vial for Raman analysis.

Raman Parameters: In this example, a THERMO SCIENTIFIC® DXR™xi Raman Imaging Microscope with OMNICxi Spectra Software set at 532 nm was used to excite the sample. The laser was run at 1 mW of power with a 2 second exposure time and 500 scans. Samples were placed on a glass slide and shaped so that a thick spot of material was produced, eliminating the possibility of the laser reaching the glass.

Example 2—Results

In this example, a dense black solid material that closely resembled the starting fly ash was observed in all samples at the conclusion of the fusion and leaching procedures in Example 1. If the samples were left to settle, large fly ash particles would be at the bottom of the sample tube, while smaller particles would be at the surface. Aliquots were taken from the middle of the solution to avoid taking solid particles for ICP-MS analysis.

The ABF fusion of the NIST 1633c fly ash reference material indicated good recovery of the lanthanides and the actinides Th and U. FIG. 1 is the average percent recovery of the lanthanides and actinides for three separate processings of the fly ash reference material. The error bars are one standard deviation of the three runs. The percent recovery of the fly ash reference material indicates that the lanthanides and actinides are extracted from the sample despite large amounts of solid remaining at the end of the procedure. Recoveries of 85-100% were observed for some other elements, such as Be, Ni, Cs, and Ba. Other elements, such as Ca, Fe, and Cr, had recoveries of 60-70%. The formation of insoluble fluorides or entrainment of elements within the remaining solid after the fusion could be the cause for the low recoveries.

Figure 2:
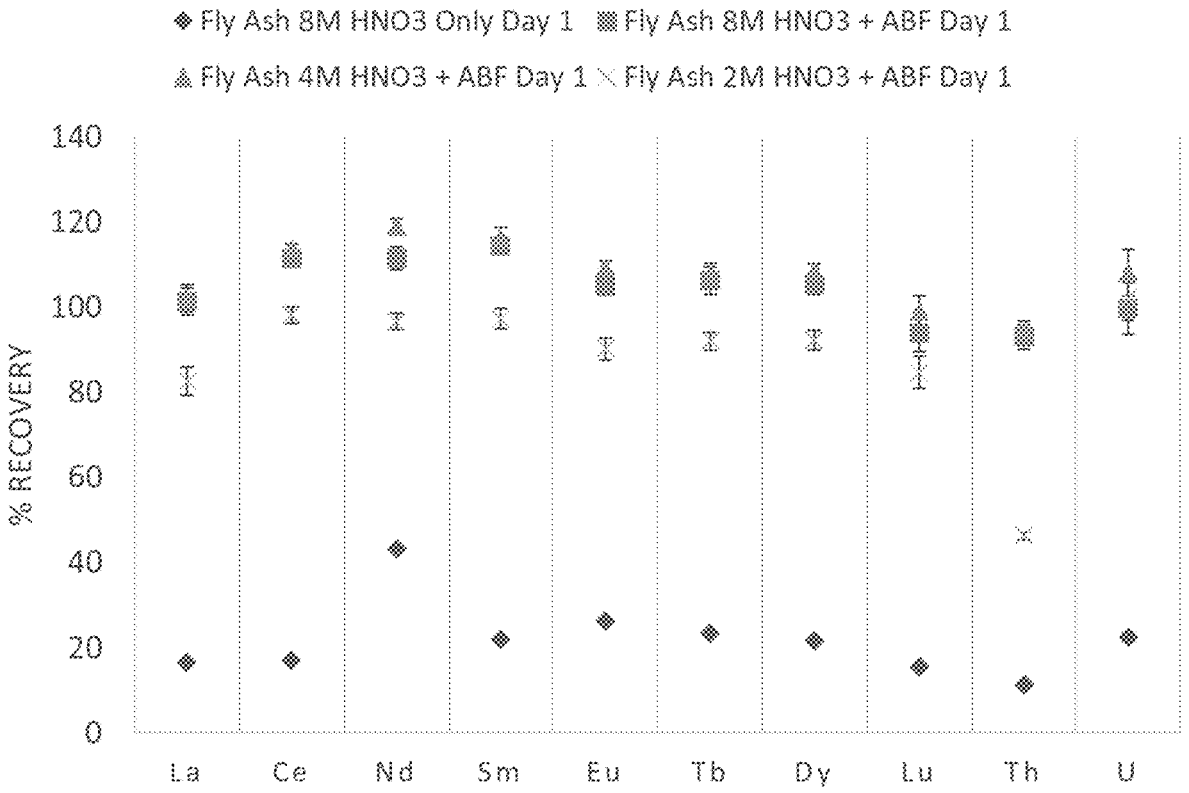
FIG. 2 shows REE recovery from NIST 1633c fly ash using an ABF and $HNO_3$ leaching solution comprising the $HNO_3$ at concentrations ranging from 2M to 8M.
Figure 3:
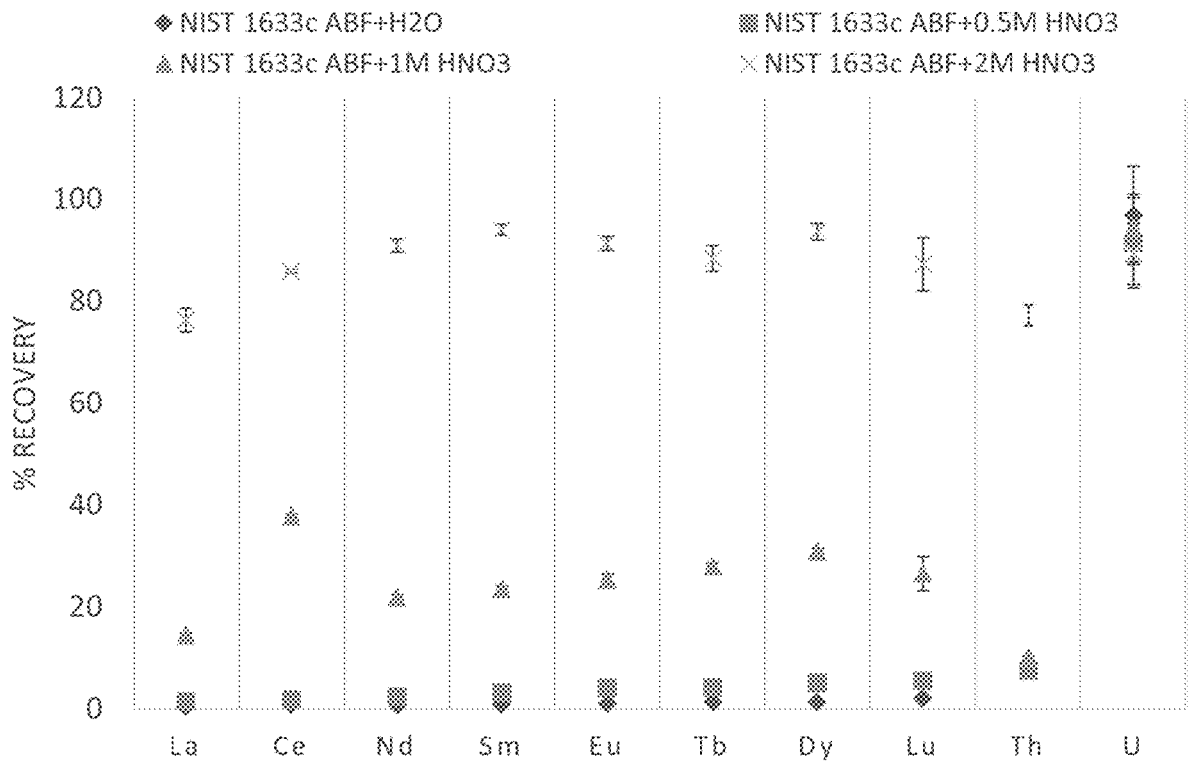
FIG. 3 shows REE recovery from NIST 1633c fly ash using an ABF and $HNO_3$ leaching solution comprising the $HNO_3$ at concentrations ranging from OM (that is, no acid) to 2M.

Recoveries of the ICP-MS analysis after one day of leaching of NIST 1633c fly ash for the varying acid concentrations are given in FIGS. 2 and 3. While aliquots spanning the two weeks were analyzed, only one day of reaction was used.

In some embodiments, the recovery of REEs from the reference fly ash was dependent on the concentration of the nitric acid. At concentrations of acid 2 M and above, quantitative recovery of REEs was achieved, but the recoveries decreased at concentrations below 2 M in some other embodiments. An exception to the observed trend is U, which solubilized in any acid concentration and in a solution of ABF and $H_2O$.

Figure 4:
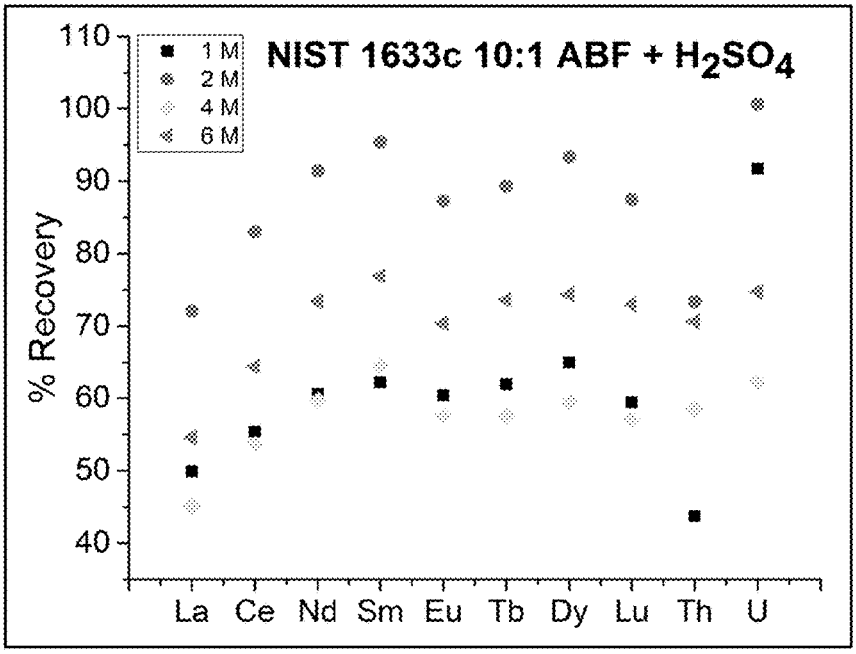
FIG. 4 shows leach recoveries of REEs, Th, and U at varying sulfuric acid concentrations.
Figure 5:
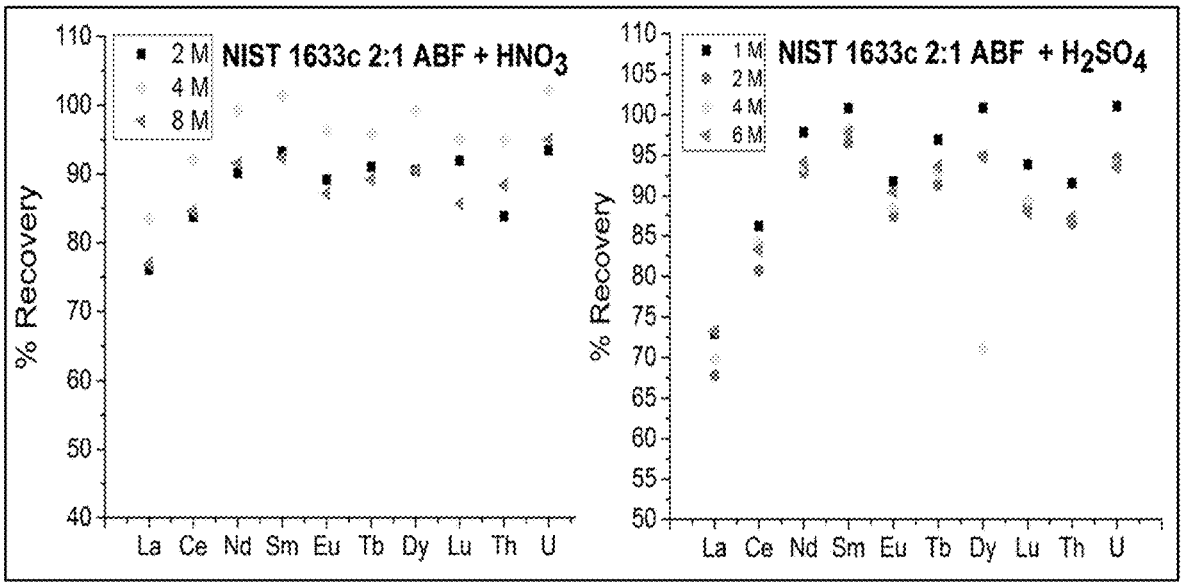
FIG. 5 shows a comparison of $HNO_3$ and $H_2SO_4$ acid concentration with an ABF to sample ratio of 2:1.

Leaching of the fly ash with varying sulfuric acid concentrations in a 10:1 ABF to sample ratio showed that the recoveries were optimized with 2 M $H_2SO_4$, as shown in FIG. 4. However, when the ratio of ABF to sample was reduced from 10:1 to 2:1, the sample recoveries for $H_2SO_4$ improved, while the nitric acid recoveries were similar to what was previously obtained (see FIG. 5).

Without being limited to a particular theory, it currently is believed that the improvement of elemental recovery in sulfuric acid with lower ABF concentration seen in some examples may be attributed to less excess fluoride in the leach solutions, which can cause precipitation of lanthanide fluoride species. The data also indicate that the leach can be performed with less concentrated acid.

Figure 6:
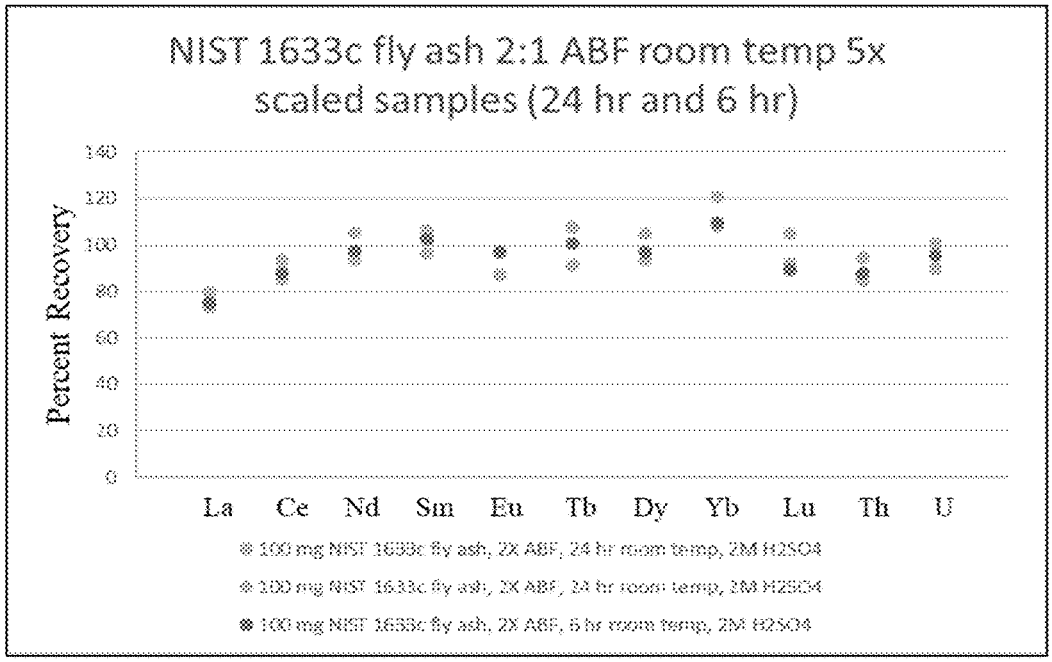
FIG. 6 shows results from a fly ash sample leaching after 6 hours and 24 hours.

Scaling up the reaction from 20 mg to 100 mg of fly ash and keeping the proportion of the reagents the same was used to successfully leach the REEs, as well as Th and U. In addition, shorter reaction time, 6 hours compared to 24 hours, can be used at both the small and large scales (see FIG. 6).

Both the ABF fusion and ABF leaching experiments demonstrate that REE recovery from coal fly ash can be accomplished using method embodiments disclosed herein. The high recoveries of the NIST 1633c reference material showed that using ABF is effective in extracting lanthanides. The leaching examples demonstrate that high temperatures can be avoided, and while higher acid concentration gives a higher elemental concentration in solution in some embodiments, REEs can still be extracted at low acid concentration. Additionally, in just an ABF and water system, U can still be quantitatively extracted, which may allow for removal of an unwanted element early before the extraction of the REEs. Further, an ABF-based leach greatly improves the recovery of the REEs compared to a leach in which only nitric acid is used.

Figure 7:
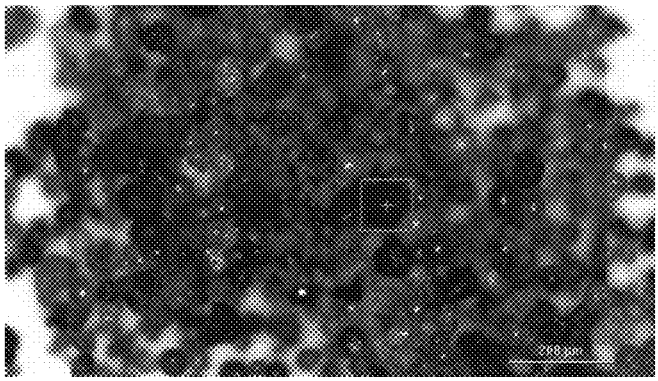
FIG. 7 is a μ-Raman optical image of unreacted NIST 1633c fly ash.

Analysis of the nitric acid boil and ABF fusion residues indicates that, when ABF is used, the silicon matrix is removed. The unreacted material was heterogeneous with differences in particle sizes, morphology, and composition. This is illustrated in FIG. 7. The red box is a previous method setting, and the laser location is approximately in the cross within the box.

Figure 8:
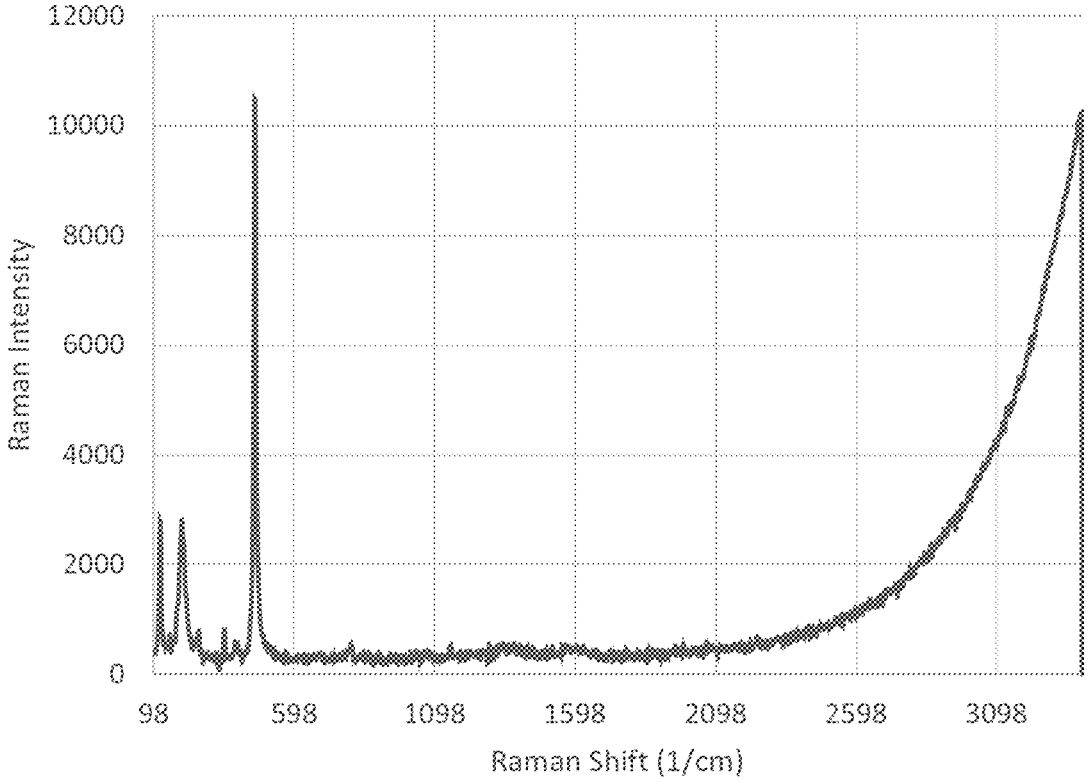
FIG. 8 is a μ-Raman spectra of a first NIST 1633c particle from FIG. 7.
Figure 9:
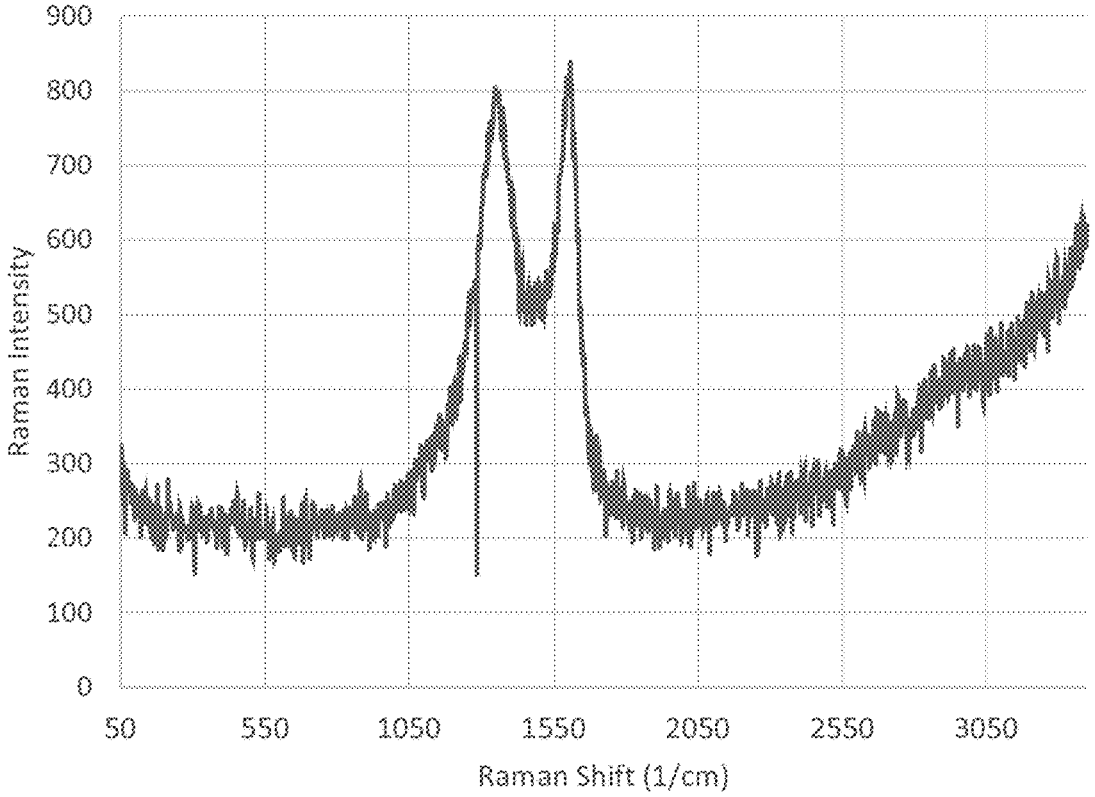
FIG. 9 is a μ-Raman spectra of a second NIST 1633c particle from FIG. 7.

Of the particles in the image, five particles of different colors and shapes were analyzed by μ-Raman for elemental components at non-adjacent locations in the sample. FIGS. 8 and 9 are examples of the obtained spectra for two of the particles. Multiple particles are needed due to the degree of heterogeneity of the particle compositions.

Many of the spectra had peaks at 1350 $cm^{-1}$, 1580 $cm^{-1}$, and 1620 $cm^{-1}$, which correspond to graphite and other carbon structures. Also identifiable in the spectra, particularly in FIG. 8, is a peak at 463 $cm^{-1}$, which is indicative of $SiO_2$. This peak was used to determine if the glassy matrix was removed from the $HNO_3$ boil and ABF fusion. Depending on the particle, other peaks were occasionally present and are believed to be associated with various iron oxides.

Figure 10:
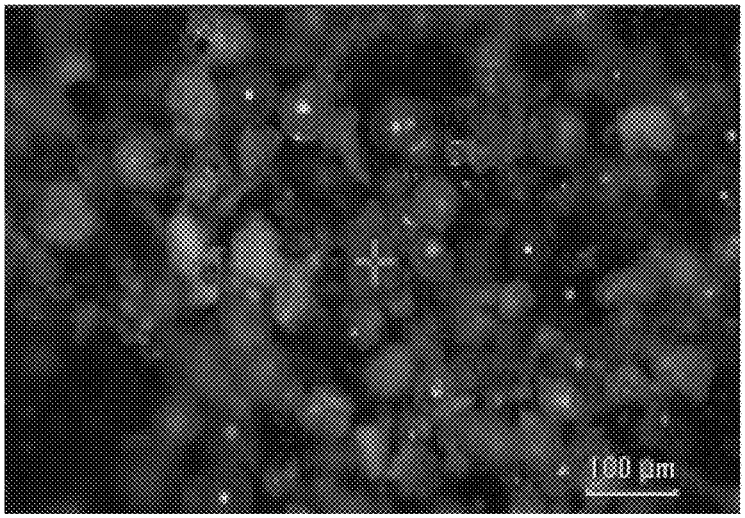
FIG. 10 is a μ-Raman optical image of NIST 1633c fly ash after $HNO_3$ boil.
Figure 11:
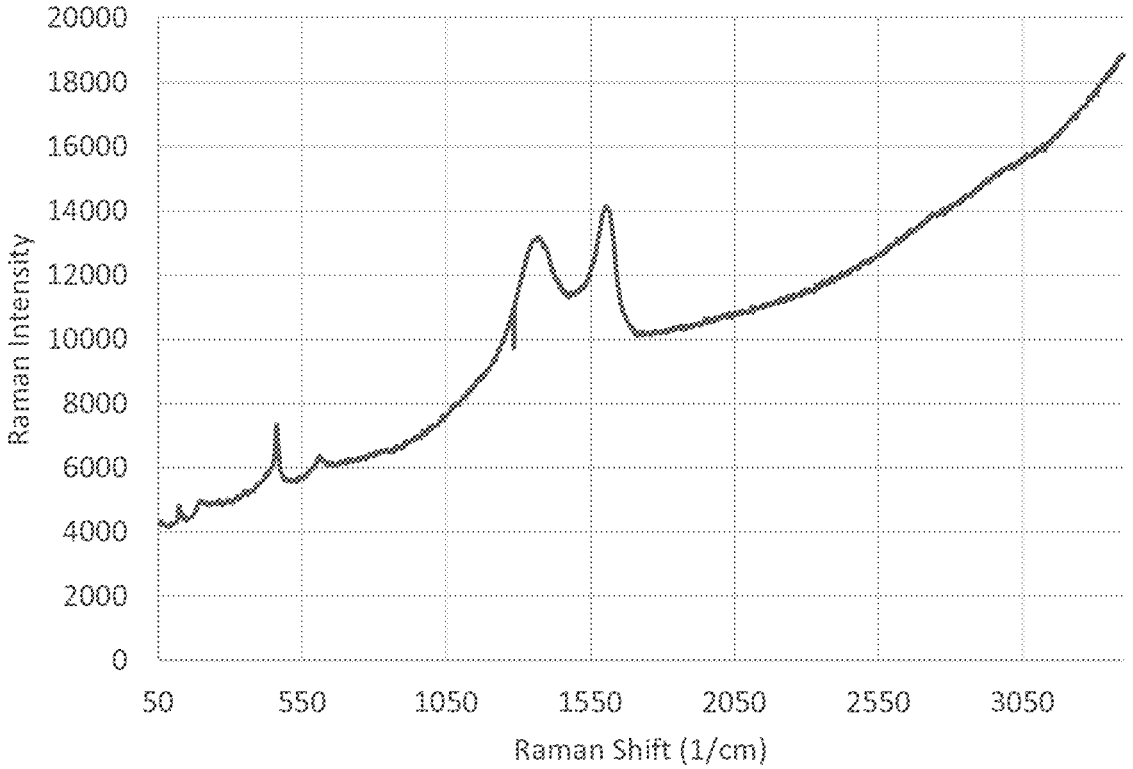
FIG. 11 is a μ-Raman spectra of a first particle from the NIST 1633c fly ash after the $HNO_3$ boil.
Figure 12:
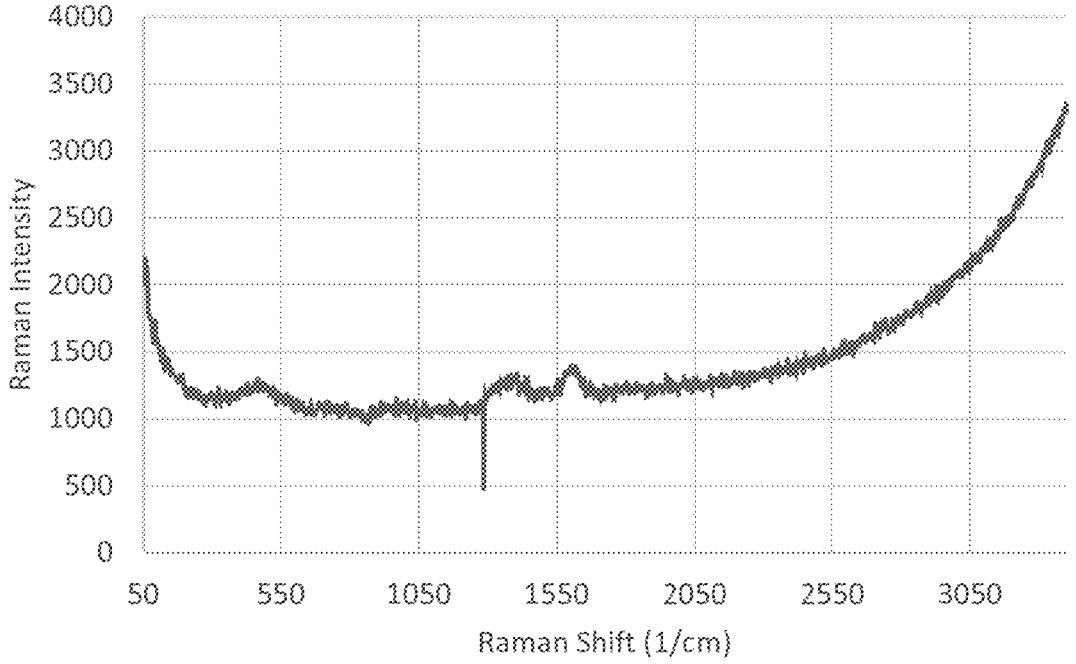
FIG. 12 is a μ-Raman spectra of a second particle from the NIST 1633c fly ash after $HNO_3$ boil.
Figure 13:
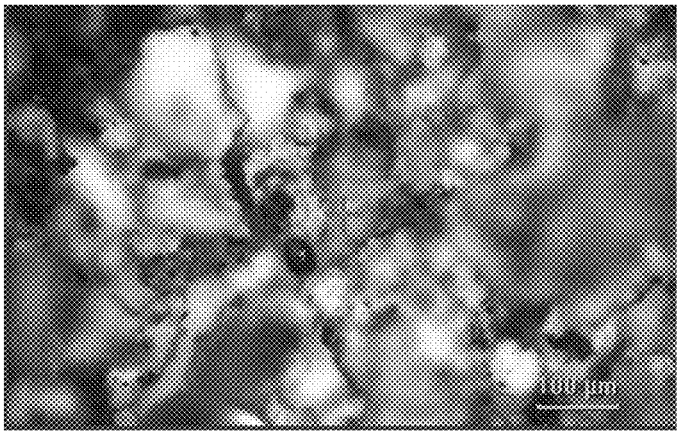
FIG. 13 is a μ-Raman optical image of NIST 1633c fly ash after ABF fusion.

FIG. 10 is an image from the μ-Raman microscope of the NIST 1633c after boiling in $HNO_3$ for two hours followed by an evaporation of the $HNO_3$. The particles of the sample following processing in boiling $HNO_3$ look similar to the unreacted sample material. Like the reference material, particles with varying colors, morphologies, and compositions were observed. Five particles at widely-spaced locations within the sample were analyzed by μ-Raman spectroscopy. Example spectra from two particles is shown in FIGS. 11 and 12. As with the original reference material, peaks associated with carbon materials (1350, 1580, and 1620 $cm^{-1}$) and $SiO_2$ (463 $cm^{-1}$) were observed in the spectra. FIG. 13 shows the optical image from the μ-Raman of the NIST 1633c fly ash following ABF fusion.

Figure 14:
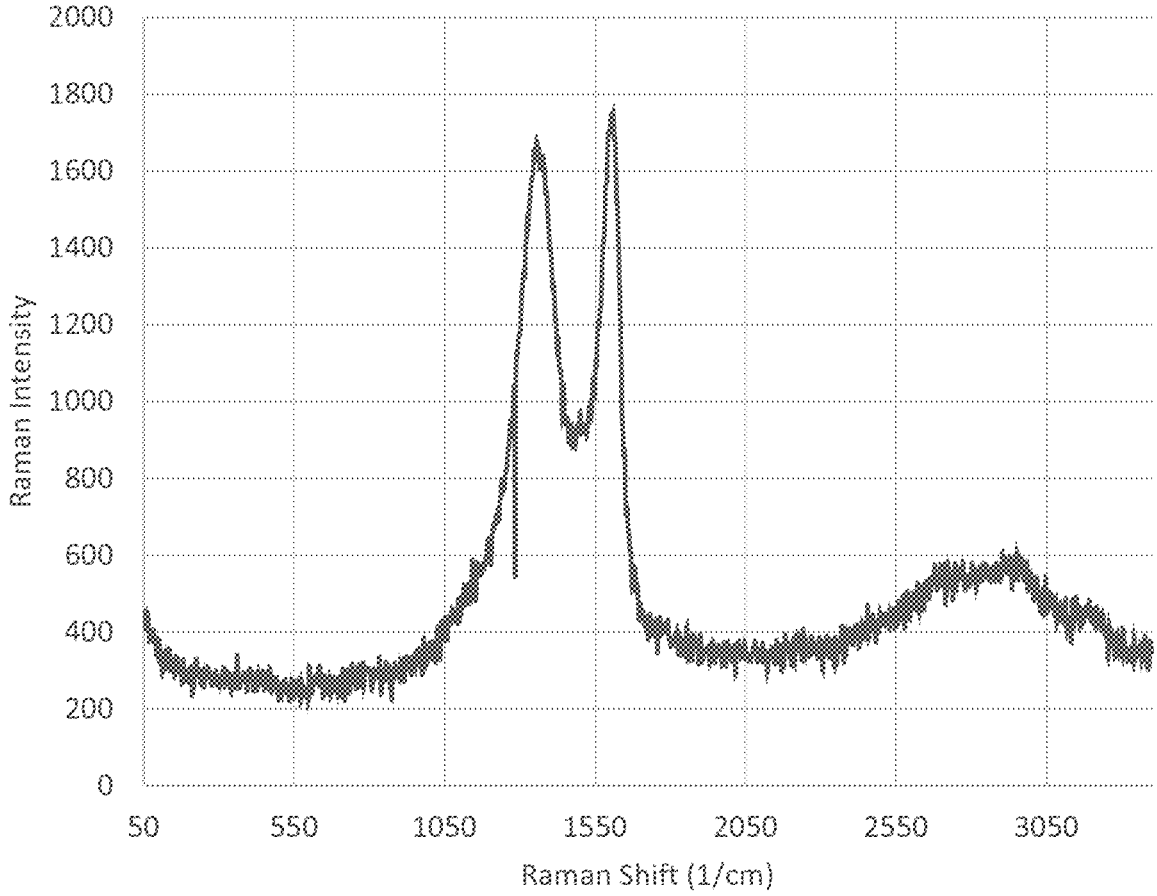
FIG. 14 is a μ-Raman spectra of a first particle from the NIST 1633c fly ash after ABF fusion.
Figure 15:
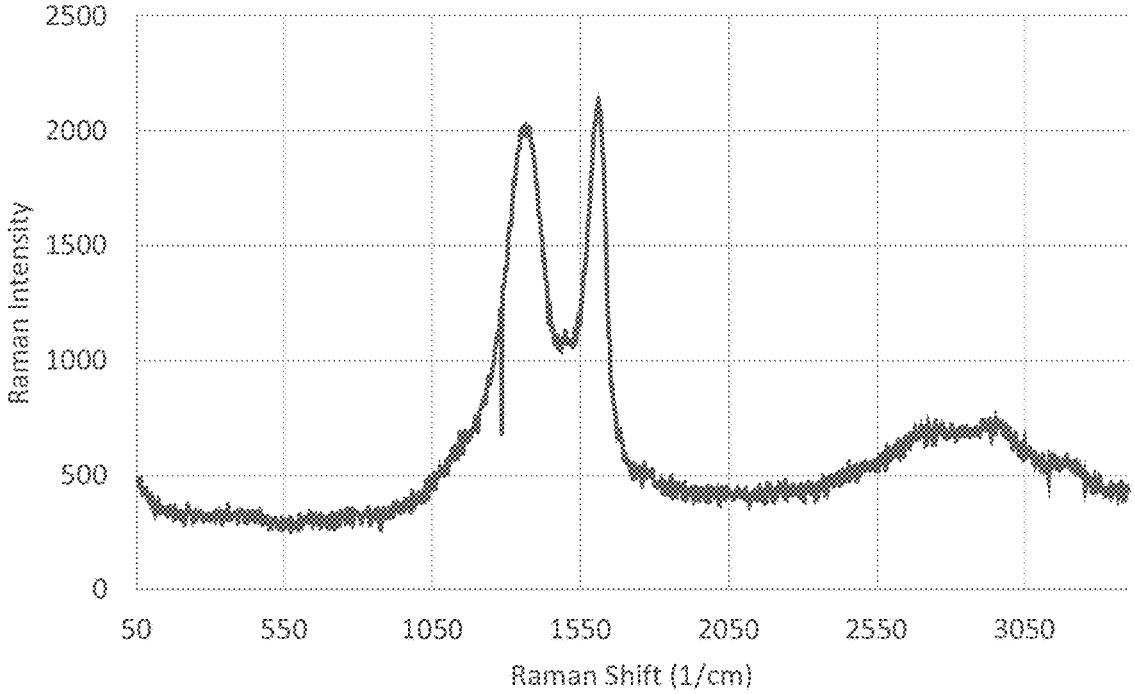
FIG. 15 is a μ-Raman spectra of a second particle from the NIST 1633c fly ash after ABF fusion.

Visually, the ABF fusion fly ash looks dramatically different than the unprocessed and nitric acid boiled fly ash samples. In contrast to the original sample and the $HNO_3$ reacted sample, which had small particles, the ABF reacted sample shows more conglomerates with a few small particles dispersed throughout. The majority of the sample appeared homogeneous in morphology and color. Five locations were analyzed, and FIGS. 14 and 15 represent the Raman spectra at two of those locations.

The spectra of particles after the ABF fusion still contained the carbon peaks at 1350, 1580, and 1620 $cm^{-1}$. Additional peaks at 2700 $cm^{-1}$ and 2900 $cm^{-1}$ of C—O vibrations were apparent along with other peaks that could be from iron oxides. These peaks were not visible in the other two samples, which exhibited a rising baseline, thought to be caused by fluorescence. The fluorescence may originate from glassy materials within the particles but is removed when the glassy materials are digested by the ABF. The 463 $cm^{-1}$ peak is not present in the particles after the fusion, indicating that the silicon-based matrix is being removed. In contrast, the $HNO_3$ boil did not show digestion of the silicon oxides. Carbon materials are left behind after the ABF fusion.

Figure 16:
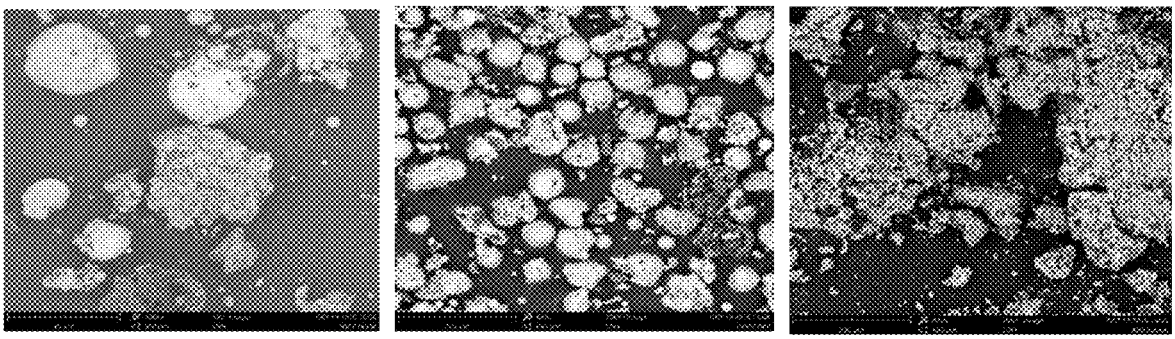
FIG. 16 shows an SEM image of NIST 1633c fly ash, after $HNO_3$ boil, and after ABF fusion.

SEM/EDS analysis was also used to confirm the mechanism of the removal of the silicon oxides from fly ash. The same materials analyzed by μ-Raman were placed on carbon tape SEM stubs and analyzed with a THERMO FISHER SCIENTIFIC® Phenom XL Desktop scanning electron microscope. FIG. 16 shows images of the SEM imaging of unreacted, $HNO_3$ boil, and ABF fusion NIST 1633c, respectively. As with the Raman analysis, the multiple locations on each sample type were analyzed to accommodate heterogeneity within the sample.

The particle morphology of the NIST fly ash after ABF fusion is distinct from the other two samples, while the unreacted material was similar to the fly ash after the nitric acid boil. These observations are consistent with the morphologies observed in the Raman analysis. Elemental composition was also measured by EDS, which also confirmed the removal of silicon from the fly ash. While the REEs were not detected by EDS, the major elemental composition was determined. Tables 2, 3, and 4 are elemental compositions of unreacted NIST 1633c fly ash at three different sample locations. The composition varied due to sample heterogeneity. Other elements, such as the REEs, were not detected.

TABLE 2

EDS analysis of NIST 1633c location 1

| Element Symbol | Atomic Conc. | Weight Conc. |
|---|---|---|
| O | 71.64 | 57.82 |
| Si | 10.97 | 15.54 |
| Al | 7.42 | 10.10 |
| C | 4.79 | 2.90 |
| Fe | 3.97 | 11.19 |
| K | 1.06 | 2.09 |

TABLE 3

| EDS analysis of NIST 1633c location 2 | | |
|---|---|---|
| Element Symbol | Atomic Conc. | Weight Conc. |
| O | 64.19 | 53.36 |
| Si | 13.24 | 19.32 |
| Al | 13.03 | 18.26 |
| C | 7.68 | 4.79 |
| K | 0.69 | 1.39 |
| Ca | 0.65 | 1.36 |
| Fe | 0.52 | 1.52 |

TABLE 4

| EDS analysis of NIST 1633c location 3 | | |
|---|---|---|
| Element Symbol | Atomic Conc. | Weight Conc. |
| C | 64.08 | 54.59 |
| O | 30.24 | 34.31 |
| Si | 2.96 | 5.90 |
| Al | 2.72 | 5.20 |

Most particles contained oxides of C, Si, and Al. Depending on the particle analyzed, other elements were detected, such as Fe and Ca. Similar results were observed for particles of NIST 1633c boiled in $HNO_3$ from Tables 5 through 7.

TABLE 5

| EDS analysis of NIST 1633c after $HNO_3$ boil location 1 | | |
|---|---|---|
| Element Symbol | Atomic Conc. | Weight Conc. |
| O | 77.10 | 66.78 |
| Al | 12.10 | 17.68 |
| Si | 9.79 | 14.88 |
| C | 1.01 | 0.66 |

TABLE 6

| EDS analysis of NIST 1633c after $HNO_3$ boil location 2 | | |
|---|---|---|
| Element Symbol | Atomic Conc. | Weight Conc. |
| O | 68.57 | 52.60 |
| C | 10.13 | 5.83 |
| Fe | 7.06 | 18.90 |
| Si | 6.38 | 8.59 |
| Al | 5.89 | 7.62 |
| Ca | 0.71 | 1.37 |
| In | 0.68 | 3.75 |
| Ti | 0.58 | 1.34 |

TABLE 7

| EDS analysis of NIST 1633c after $HNO_3$ boil location 3 | | |
|---|---|---|
| Element Symbol | Atomic Conc. | Weight Conc. |
| O | 60.29 | 54.43 |
| C | 24.48 | 16.59 |
| Si | 7.38 | 11.70 |

TABLE 7-continued

| EDS analysis of NIST 1633c after $HNO_3$ boil location 3 | | |
|---|---|---|
| Element Symbol | Atomic Conc. | Weight Conc. |
| A | 5.88 | 8.95 |
| Fe | 1.27 | 3.99 |

Again, the EDS analysis showed little to no difference between the unreacted sample and the material boiled in $HNO_3$. The EDS of the material reacted with ABF showed differing elemental composition. Tables 8 through 10 are the results of analyses on different spots of the sample after fusion.

TABLE 8

| EDS analysis of NIST 1633c after ABF fusion location 1 | | |
|---|---|---|
| Element Symbol | Atomic Conc. | Weight Conc. |
| F | 73.42 | 69.66 |
| O | 13.40 | 10.70 |
| Al | 11.65 | 15.70 |
| Fe | 1.09 | 3.05 |

TABLE 9

| EDS analysis of NIST 1633c after ABF fusion location 2 | | |
|---|---|---|
| Element Symbol | Atomic Conc. | Weight Conc. |
| F | 73.68 | 69.36 |
| Al | 11.31 | 15.12 |
| N | 11.11 | 7.71 |
| Fe | 2.41 | 6.66 |
| C | 1.45 | 0.86 |

TABLE 10

| EDS analysis of NIST 1633c after ABF fusion location 3 | | |
|---|---|---|
| Element Symbol | Atomic Conc. | Weight Conc. |
| F | 71.12 | 69.36 |
| O | 11.05 | 9.07 |
| Al | 9.14 | 12.66 |
| N | 6.25 | 4.50 |
| Fe | 1.29 | 3.70 |
| C | 1.15 | 0.71 |

The residue following the ABF fusion did not exhibit Si content, which is consistent with the data collected by Raman spectroscopy. Even though the morphology of the ABF digested material became more homogenized, the composition did not so several measurements were obtained. The elemental concentrations varied with the area analyzed.

In contrast to geologic materials where aluminum was completely recovered following the ABF fusion, the fly ash residue still contained measurable amounts. Several studies have shown that fly ash contains several mineral phases such as quartz ($SiO_2$), mullite ($Si_6Al_2O_{13}$), magnetite ($Fe_3O_4$), hematite ($Fe_2O_3$), calcium aluminates, corundum ($\alpha$-$Al_2O_3$), and various glasses. Mullite has been found to be stable below 1973 K and was found in fly ash residues that were reacted with 1% HF. Others describe mullite as refractory and require extreme conditions to digestion. The sonication experiments also showed that some mineral phases of $Al_2O_3$ are more refractory than others and require more extreme conditions. Therefore, the presence of Al in the fly ash residue may be due to more refractory mineral phases within the fly ash as opposed to geologic materials.

Thus, ABF allows for the efficient extraction of rare earth elements from coal fly ash. Comparison of residues following reaction with concentrated $HNO_3$ and by ABF fusion to unreacted material shows that ABF destroys the silicon matrix, releasing the REEs into solution. Fusion of NIST 1633c fly ash reference material with ABF showed quantitative recovery of rare earth elements. Analysis of the residue left behind from the fusion indicates that the silicate matrices within the fly ash were attacked, which, without being bound by theory, likely allowed for the release of REEs. Low-temperature leaching with ABF and mineral acids, such as $HNO_3$ and $H_2SO_4$, was also evaluated, showing quantitative recovery from the reference fly ash in one day at acid concentrations of 2 M. Analysis of the fly ash residues after leaching showed similar loss of the Si phase, although the morphology is not as homogenous as the fusion fly ash residue. Further, these examples provide observations that support release of REEs from Si phases within the fly ash by the ABF and mineral acids enabling the REEs to then be dissolved into solution.

In view of the many possible embodiments to which the principles of the disclosure may be applied, it should be recognized that the illustrated embodiments are only preferred examples of the invention and should not be taken as limiting the scope. Rather, the scope is defined by the following claims. We therefore claim as our invention all that comes within the scope and spirit of these claims.

We claim:

1. A method, comprising:

contacting a coal combustion product comprising at least one target element or a compound thereof and an aluminosilicate or silicate with:

(i) a first treatment of ammonium bifluoride and water to extract an actinide from the coal combustion product; and (ii) a second treatment of ammonium bifluoride and an aqueous solution comprising an acid to extract a lanthanide, Al, Sc, Y, or a combination thereof from the coal combustion product; provided that the method does not comprise exposing the coal combustion product, the ammonium bifluoride, or the at least one aqueous solution to microwaves or sonication.

2. The method of claim 1, wherein the aqueous solution further comprises water.

3. The method of claim 1, wherein the actinide is selected from actinium, thorium, uranium, protactinium, or a combination thereof.

4. The method of claim 1, wherein the actinide is U.

5. The method of claim 1, further comprising recovering, concentrating, and/or separating the (i) actinide and/or (ii) the lanthanide, Al, Sc, Y, or the combination thereof using ion exchange and/or solvent extraction.

6. The method of claim 1, wherein the acid is an inorganic acid or an organic acid.

7. The method of claim 6, wherein the inorganic acid is selected from sulfuric acid, hydrochloric acid, nitric acid, or a combination thereof; and wherein the organic acid is selected from oxalic acid, acetic acid, or citric acid.

8. The method of claim 6, wherein the acid has a concentration ranging from 0.5 M to 2 M.

9. The method of claim 6, wherein the acid has a concentration ranging from 1 M or 2 M.

10. The method of claim 1, wherein the first treatment and/or the second treatment occurs at a temperature ranging from 18° C. to 100° C.

11. The method of claim 1, wherein the first treatment and/or the second treatment occurs at a temperature below 80° C.

12. The method of claim 1, wherein the coal combustion product is contacted with the water for a time period ranging from 30 minutes to 24 hours and is contacted with the aqueous solution for a time period ranging from 30 minutes to 24 hours.

13. The method of claim 1, wherein the coal combustion product comprises fly ash, bottom ash, or boiler slag.

14. The method of claim 1, wherein the coal combustion product comprises fly ash.

15. A method, comprising: contacting, at room temperature, fly ash with (i) a first treatment of ammonium bifluoride and water to extract, an actinide present in the fly ash, and (ii) a second treatment of ammonium bifluoride and an aqueous solution comprising an acid to extract a lanthanide, Al, Sc, Y, or a combination thereof present in the fly ash.

16. The method of claim 15, wherein the actinide is selected from actinium, thorium, uranium, protactinium, or a combination thereof.

17. The method of claim 15, wherein the acid is selected from sulfuric acid, hydrochloric acid, nitric acid, oxalic acid, acetic acid, or citric acid.

* * * * *